US008414110B2

(12) United States Patent
Kato et al.

(10) Patent No.: US 8,414,110 B2
(45) Date of Patent: Apr. 9, 2013

(54) INKJET HEAD

(75) Inventors: Masaki Kato, Tokyo (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/229,803

(22) Filed: Sep. 12, 2011

(65) Prior Publication Data

US 2012/0069101 A1 Mar. 22, 2012

(30) Foreign Application Priority Data

Sep. 16, 2010 (JP) ..... 2010-208206

(51) Int. Cl.
*B41J 2/14* (2006.01)

(52) U.S. Cl. ..... 347/50; 347/70; 347/71; 347/68

(58) Field of Classification Search ..... 347/50, 347/70, 71, 68
See application file for complete search history.

(56) References Cited

U.S. PATENT DOCUMENTS 6,089,701 A * 7/2000 Hashizume et al. ..... 347/70
6,231,169 B1 5/2001 Yazaki et al.

FOREIGN PATENT DOCUMENTS

JP 11-291497 10/1999
JP 2004-082623 3/2004
JP 2004-154987 6/2004
JP 2005-144847 6/2005
JP 2007-118265 5/2007

* cited by examiner

*Primary Examiner* — Matthew Luu
*Assistant Examiner* — Henok Legesse
(74) *Attorney, Agent, or Firm* — IPUSA, PLLC

(57) ABSTRACT

An inkjet head includes a channel substrate having multiple individual liquid chambers arranged in a shorter-side direction of the channel substrate, the individual liquid chambers being separated by multiple liquid chamber partition walls and communicating with ink supply openings; multiple diaphragms defining surfaces of the individual liquid chambers facing toward nozzle openings; multiple actuators formed on the diaphragms, each of the actuators being formed of a lower electrode, a piezoelectric element, and an upper electrode stacked in layers; and multiple individual electrode interconnects led out from the upper electrodes of the actuators, the individual electrode interconnects being connected to the corresponding upper electrodes on the nozzle opening side and on the ink supply opening side of the upper electrodes, the individual electrode interconnects being formed in regions where the liquid chamber partition walls are formed.

6 Claims, 9 Drawing Sheets

INKJET HEAD

CROSS-REFERENCE TO RELATED APPLICATION

The present application is based upon and claims the benefit of priority of Japanese Patent Application No. 2010-208206, filed on Sep. 16, 2010, the entire contents of which are incorporated herein by reference.

BACKGROUND OF THE INVENTION

1. Field of the Invention

The present invention relates generally to an inkjet head, and more particularly to an inkjet head including a channel substrate in which individual liquid chambers separated by liquid chamber partition walls and communicating with respective ink supply ports are arranged in a widthwise direction of the inkjet head; diaphragms defining the surfaces of the individual liquid chambers facing toward nozzle orifices provided in the individual liquid chambers; and actuators each formed of stacked layers of a lower electrode, a piezoelectric element, and an upper electrode on the corresponding diaphragm.

2. Description of the Related Art

Conventionally, inkjet heads configured to cause liquid to be ejected from microscopic nozzles formed in individual liquid chambers by causing variations in pressure in the individual liquid chambers and recording apparatuses having such inkjet heads are known.

Multiple systems for causing variations in pressure in the individual liquid chambers of inkjet heads have been reduced to practice and commercialized. Examples of such systems include thermal inkjet systems that vaporize liquid by providing a heater in the individual liquid chambers and systems with actuators provided in the individual liquid chambers. Examples of systems with actuators, which vary depending on types of actuators, include piezoelectric element systems and electrostatic systems.

Although it is possible to support inks of a wide variety of physical properties with systems using actuators, it has been considered difficult to increase the arrangement density of individual liquid chambers or reduce head size with systems using actuators. In recent years, however, techniques for increasing the arrangement density of individual liquid chambers using a MEMS (Microelectromechanical System) process have been being established. That is, it is possible to increase the arrangement density of individual liquid chambers by stacking a diaphragm, electrodes, a piezoelectric body, etc., on the individual liquid chambers using a thin film deposition technique and patterning individual piezoelectric elements and interconnects using a semiconductor device manufacturing process (photolithography).

The lower electrode, piezoelectric body, upper electrode, etc., of a piezoelectric element, which are formed using a thin film deposition process as described above, are difficult to stack into layers of 5 μm or more in film thickness. It is necessary for an electrode material to be 1 μm or less in thickness in view of process cost.

In particular, in the piezoelectric body, which is deposited as a film by a thin film deposition process, degradation due to the process environment of photolithography (including temperature and process gas) or degradation due to the number of times of driving, temperature, humidity, etc., tends to be more conspicuous than in the bulk.

It is believed that the degradation is caused by the oxygen deficiency of perovskite oxide, which is widely used as a piezoelectric material, or the diffusion of an element such as Pb. It is considered effective against this degradation to use electrically conductive oxide materials, etc., as electrode materials. However, such oxide materials have problems such as high electrical resistance and high contact (connection) resistance with an interconnect material (metal).

Further, an increase in the density of the piezoelectric elements makes it difficult to establish contact (connections) between the upper electrodes and individual electrode interconnects led out from the upper electrodes to individually drive the piezoelectric elements. At the same time, there is the effect of a voltage drop in the upper electrodes caused by an increase in the resistance of the upper electrodes due to reduction in film thickness and reduction in size. Therefore, there is the issue of the uniform driving of the piezoelectric elements.

The easiest way to address these issues is to stack a metal layer on the upper electrodes. This, however, has the problem of an increase in process cost and the above-described problem of the degradation of the piezoelectric body.

With respect to reduction in interconnect (wiring) resistance, for example, Patent Document 1 listed below describes a technique related to a common electrode. Patent Document 1 illustrates controlling a voltage drop among elements due to the resistance of a common electrode and reducing variations among the elements by increasing the number of contacts of the common electrode and providing bypass interconnects using a lead-out interconnection process. Further, Patent Document 2 listed below describes forming interconnects using a process for forming a led-out interconnect from each longitudinal end of a piezoelectric element.

Further, in the case of using a piezoelectric element formed by a thin film deposition process, the diaphragm is a thin film of a few μm in thickness. Therefore, there is a problem in that the diaphragm is likely to be deformed by residual stress due to stacking the piezoelectric element on the diaphragm. Further, since a substrate in which a channel is formed is reduced in thickness, ensuring strength and improving process accuracy in a manufacturing process have become an issue. As measures for addressing these issues, techniques using a holding substrate have been proposed as described in Patent Documents 3 through 5 listed below.

Patent Documents 3 and 4 describe patterning a multilayer structure including electrodes in a region opposed to a partition wall. Patent Document 5 listed below describes controlling the deflection of diaphragms by forming vibration chambers in a holding substrate, and grinding a channel plate and forming liquid chambers in the channel plate by etching after joining the holding substrate and the channel plate.

[Patent Document 1] Japanese Laid-Open Patent Application No. 2007-118265

[Patent Document 2] Japanese Laid-Open Patent Application No. 2004-154987

[Patent Document 3] Japanese Laid-Open Patent Application No. 2004-082623

[Patent Document 4] Japanese Laid-Open Patent Application No. 2005-144847

[Patent Document 5] Japanese Laid-Open Patent Application No. 11-291497

SUMMARY OF THE INVENTION

According to an aspect of the present invention, an inkjet head includes a channel substrate having a plurality of individual liquid chambers arranged in a shorter-side direction thereof, the individual liquid chambers being separated by a plurality of liquid chamber partition walls and communicating with ink supply openings; a plurality of diaphragms defining surfaces of the individual liquid chambers facing toward nozzle openings; a plurality of actuators formed on the diaphragms, each of the actuators being formed of a lower electrode, a piezoelectric element, and an upper electrode stacked in layers; and a plurality of individual electrode interconnects led out from the upper electrodes of the actuators, the individual electrode interconnects being connected to the corresponding upper electrodes on a nozzle opening side and on an ink supply opening side of the upper electrodes, the individual electrode interconnects being formed in regions where the liquid chamber partition walls are formed.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

The above-described conventional techniques indicate that it is possible to reinforce the edges of diaphragms and increase the rigidity of a channel substrate by providing partition walls between piezoelectric elements and joining the channel substrate to a holding substrate. That is, according to the above-described conventional techniques, it is possible to reduce crosstalk caused by an increase in the density of the piezoelectric elements and at the same time to increase mass productivity through improvement in handling in a manufacturing process. The above-described conventional techniques, however, remain silent about measures for the above-described connection reliability and resistance reduction of upper electrodes.

According to an aspect of the present invention, an inkjet head is provided that is improved in the connection reliability of the upper electrodes of piezoelectric elements and the rigidity of the edges of diaphragms.

First Embodiment

A description is given, with reference to the accompanying drawings, of a first embodiment of the present invention.

Figure 1A:
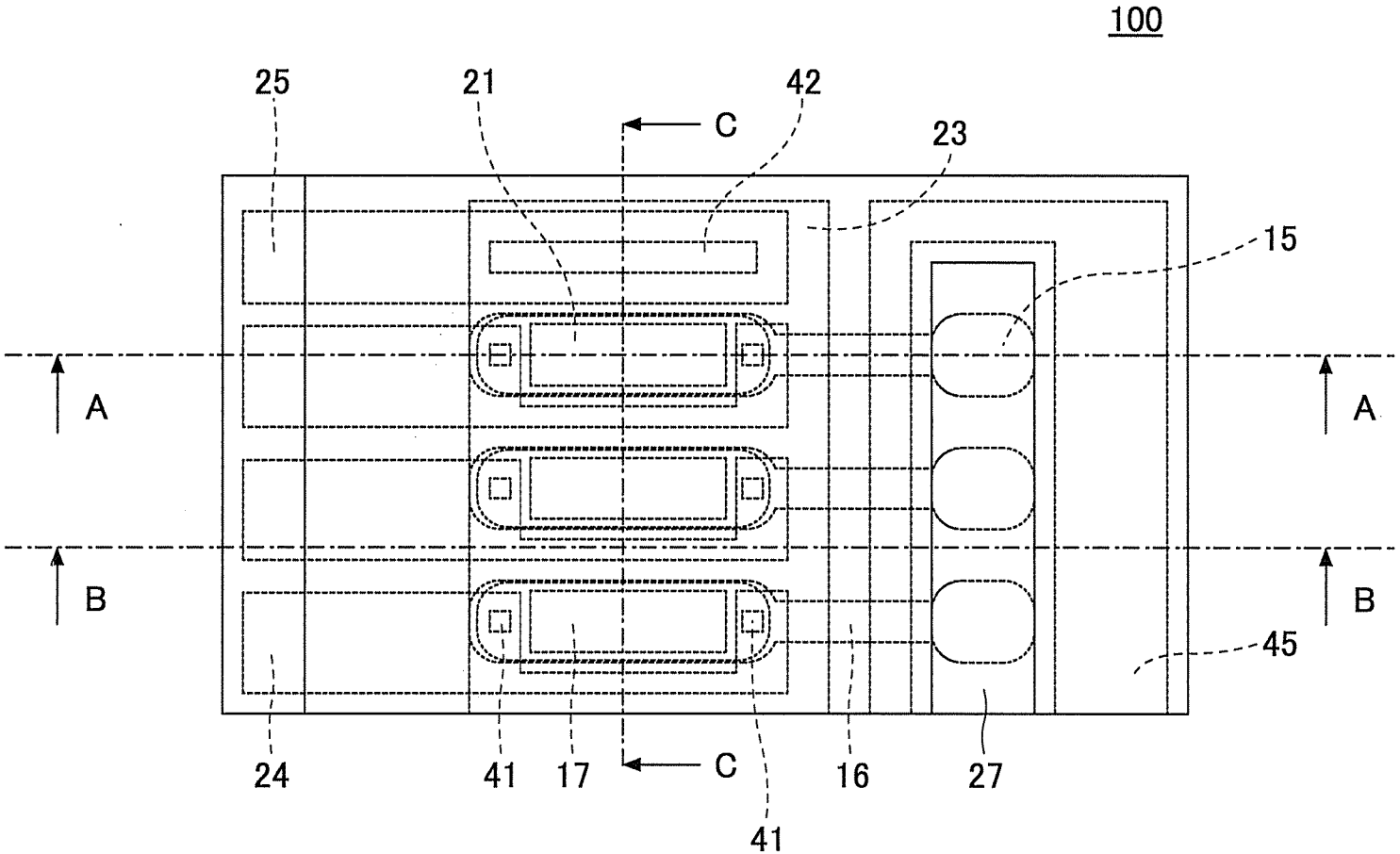
FIGS. 1A through 1D are diagrams illustrating a configuration of an inkjet head according to a first embodiment.
Figure 1B:
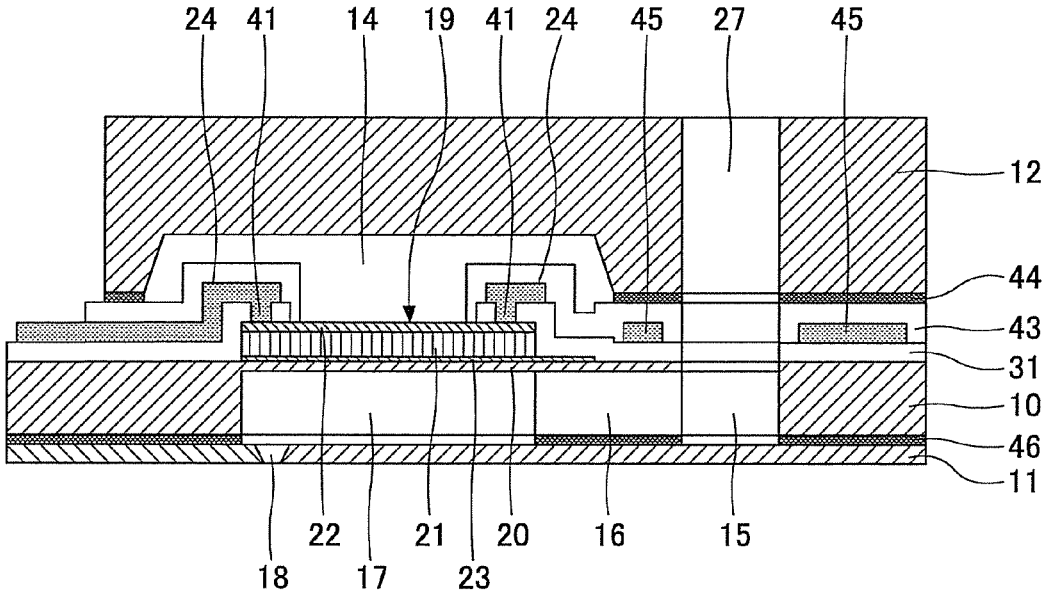
Figure 1C:
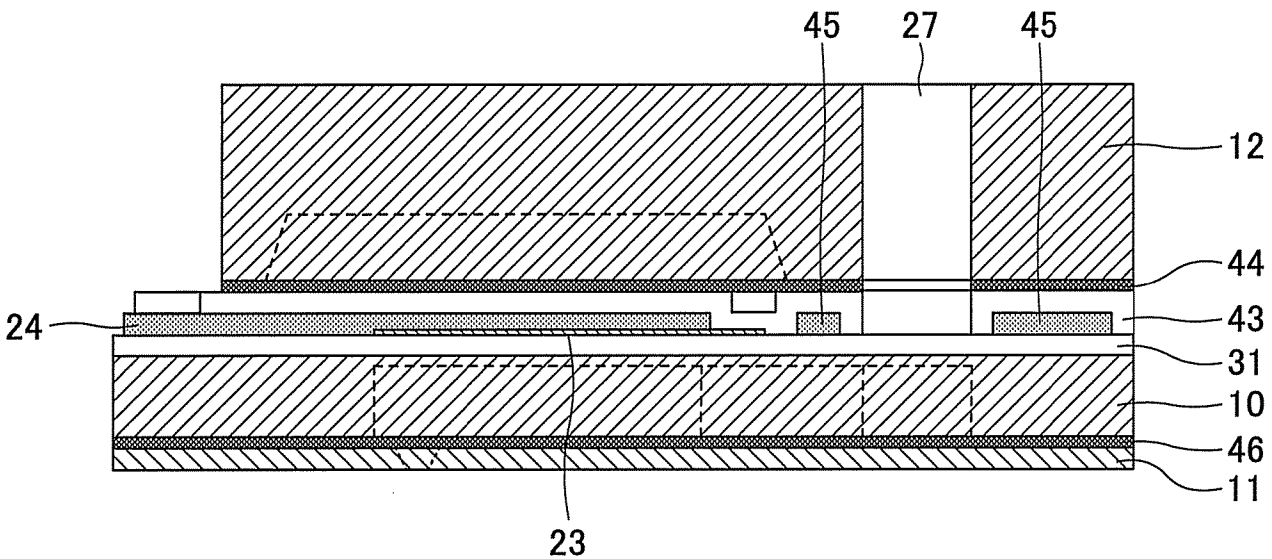
Figure 1D:
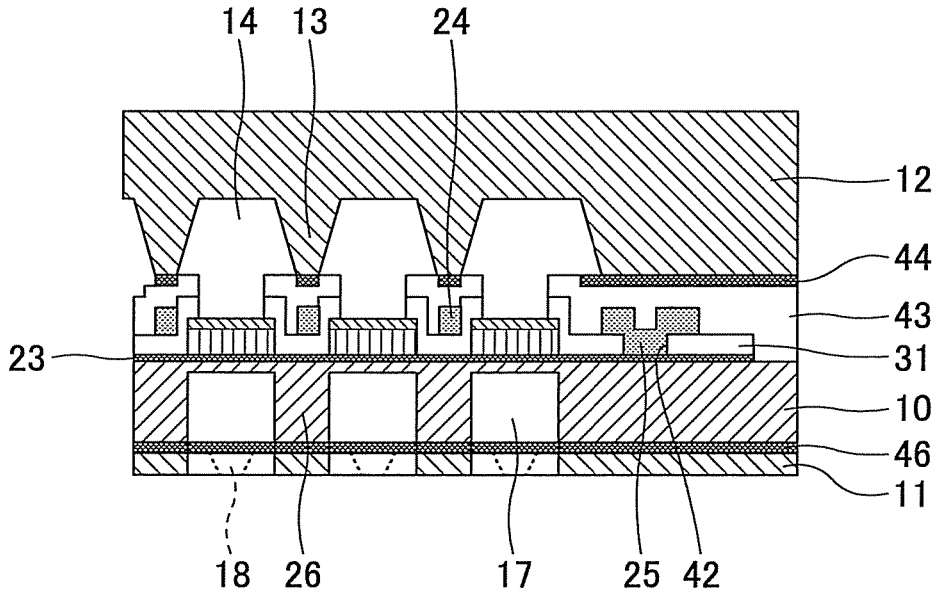

FIGS. 1A through 1D are schematic diagrams illustrating a configuration of an inkjet head 100 according to the first embodiment. FIG. 1A is a plan view of the inkjet head 100, FIG. 1B is a cross-sectional view of the inkjet head 100 taken along a plane indicated by arrows A in FIG. 1A. FIG. 1C is a cross-sectional view of the inkjet head 100 taken along a plane indicated by arrows B in FIG. 1A. FIG. 1D is a cross-sectional view of the inkjet head 100 taken along a plane indicated by arrows C in FIG. 1A.

The inkjet head 100 of this embodiment includes a channel substrate 10, a nozzle plate 11, and a holding substrate 12.

The holding substrate 12 has multiple vibration chambers 14 separated by partition walls 13 and arranged side by side in a direction of the width of the vibration chambers 14 (FIG. 1D). Channels that guide ink or liquid supplied from ink supply openings 15 to individual liquid chambers 17 via fluid resistance parts 16 are formed in the channel substrate 10. The fluid resistance parts 16 are provided one for each individual liquid chamber 17, and are smaller in width (narrower) than the individual liquid chambers 17. The fluid resistance parts 16 keep constant the fluid resistance of ink or liquid flowing from the ink supply openings 15 to the individual liquid chambers 17.

The nozzle plate 11, in which nozzles 18 are formed, is joined to the bottom of the channel substrate 10. In the inkjet head 100, diaphragms 20 formed at the top of the individual liquid chambers 17 are displaced to generate variations in pressure in the individual liquid chambers 17 to cause ink liquid droplets from the nozzles 18. Actuators 19 that displace the diaphragms 20 are formed on the diaphragms 20.

According to this embodiment, the actuators 19 use piezoelectric elements 21, which allows large displacements. Upper electrodes 22 are formed on the piezoelectric elements 21 on their vibration chamber 14 side. A lower electrode 23 is formed between the piezoelectric elements 21 and the diaphragms 20. Individual electrode interconnects 24 for providing the piezoelectric elements 21 with respective signals are led out from the upper electrodes 22. A common electrode interconnect 25 for providing a common signal to the piezoelectric elements 21 is led out from the lower electrode 23.

According to this embodiment, the actuators 19 may be driven to cause ink liquid droplets to be ejected by inputting drive signals to the upper electrodes 22 and the lower electrode 23 via the individual electrode interconnects 24 and the common electrode interconnect 25.

The drive signals are input from an integrated circuit (IC) joined via a flexible printed circuit (FPC) or by wire bonding to the individual electrode interconnects 24 and the common electrode interconnect 25. The individual liquid chambers 17 are arranged in a direction of the shorter side (a widthwise direction) of the channel substrate 10, and are separated (defined) by liquid chamber partition walls 26. The ink supply openings 15 are provided one for each individual liquid chamber 17. The fluid resistance parts 16 are provided one for each individual liquid chamber 17. The nozzles 18 are provided one for each individual liquid chamber 17.

Ink is supplied from a common liquid chamber 27 formed in the holding substrate 12 via the ink supply openings 15. Ink may be supplied to the common liquid chamber 27 via a supply channel. For example, ink may be supplied from a reservoir tank.

The nozzle plate 11 is a substrate in which the nozzles 18 are formed in positions corresponding to the individual liquid chambers 17. According to embodiments of the present invention, there is a one-to-one correspondence between the individual liquid chambers 17 and the nozzles 18, and the nozzles 18 are arranged in the same direction as the individual liquid chambers 17.

With respect to the nozzle plate 11, it is desirable to determine an appropriate material and thickness in view of processability and material properties (mechanical properties).

Examples of the material of the nozzle plate 11 include metals, alloys, dielectrics, semiconductors, and resins. In view of material strength, it is preferable to select the material from among metals, alloys, dielectrics, and semiconductors. In the case of using resin, it is desired to increase thickness in order to ensure sufficient rigidity. Accordingly, resin is less preferable in light of maintaining the processing accuracy of a nozzle shape.

Insufficient rigidity of the nozzle plate 11 causes an increase in the fluid compliance of the individual liquid chambers 17, thus increasing the loss of the energy generated by the actuators 19. In the case of selecting the material of the nozzle plate 11 from among metals, alloys, dielectrics, and semiconductors, it is desired to take suitability with an ink material into consideration. That is, it is desired to select a material free of corrosion, dissolution, or property changes due to contact with ink over a long period of time, or to perform surface treatment.

Examples of the method of processing (forming) the nozzles 18 include etching, laser processing, and a technique using press working and grinding in the case where the material of the nozzle plate 11 is a metal or an alloy. Of these, press working is preferable in light of the uniformity of nozzle size. In the case where the material of the nozzle plate 11 is a dielectric or a semiconductor, laser processing or a technique using photolithography (such as dry etching and wet etching) may be used as a processing technique. It is desired to select a processing technique that allows both mass productivity and accuracy in accordance with the material of the nozzle plate 11 described above.

With respect to the nozzles 18, it is desired to select an appropriate nozzle size (diameter) and shape based on the physical properties of ink, the arrangement density (resolution) of the individual liquid chambers 17, and the performance of the actuators 19. According to this embodiment, the inkjet head 100 assumes a resolution of 150 dpi to 600 dpi per line. Accordingly, the nozzle size is preferably approximately 12 μm to approximately 30 μm, and the nozzle cross-sectional shape is preferably a tapered shape as illustrated in FIG. 1B.

In forming the nozzles 18, it is desired to increase the accuracy of the nozzle size, roundness (circularity), and the inclination of the nozzle central axis. It is preferable to control their variations because their variations cause variations in the direction of ejection (ejection curving), the size of liquid droplets, the velocity of ejection, etc.

In view of the above, considering the durability against ink, processing accuracy, and processing cost, an alloy having high corrosion resistance (such as stainless used steel [SUS]) subjected to press working and grinding is preferable as the material of the nozzle plate 11 of this embodiment. The nozzle plate 11 is joined to the channel substrate 10 using a known technique such as one using an adhesive agent. According to this embodiment, the nozzle plate 11 and the channel substrate 10 are joined with a nozzle plate adhesion layer 46.

As the material of the channel substrate 10 of this embodiment, any material may be selected from among metals, dielectrics, and semiconductors. It is desired to select an appropriate material in view of material strength and processability. Considering that the ink supply openings 15, the fluid resistance parts 16, and the individual liquid chambers 17 with high density using a semiconductor process (photolithography), silicon (a silicon wafer) is preferable as the material of the channel substrate 10.

The channels from the ink supply openings 15, which are through holes, through the fluid resistance parts 16 to the individual liquid chambers 17, which communicate with the nozzles 18, are formed in the channel substrate 10. For their respective shapes, it is desired to select optimum values based on ink properties and actuator characteristics. Taking the case of arranging the individual liquid chambers 17 at 300 dpi as an example, the individual liquid chambers 17 are 50 μm to 70 μm in width (in a shorter-side direction), 600 μm to 1600 μm in length (in a longer-side direction), and 50 μm to 100 μm in depth. The liquid chamber partition walls 26 separating the individual liquid chambers 17 are preferably 10 μm to 40 μm in thickness. It is desired to reduce the width of the liquid chamber partition walls 26 in order to increase density. However, if the width of the liquid chamber partition walls 26 is less than 10 μm, the rigidity may be insufficient to cause the crosstalk of pressure variations between adjacent individual liquid chambers 17, thus affecting the ejection stability in the case of driving the adjacent individual liquid chambers 17.

The diaphragms 20 are formed at the bottom of the individual liquid chambers 17 in the channel substrate 10 to define (bottom) surfaces which face toward the nozzles 18. Examples of the material of the diaphragms 20 include metals, alloys, dielectrics, and semiconductors. According to this embodiment, because of high rigidity and processability, a dielectric, a semiconductor, or a multilayer structure of a dielectric/dielectrics and/or a semiconductor/semiconductors is preferable as the material of the diaphragms 20.

Examples of dielectric materials include oxides such as $Al_2O_3$, $ZrO_2$, $TiO_2$, $SiO_2$, and $Y_2O_3$, nitrides such as SiN, TiN, and AlN, and carbides such as TiC and SiC. Examples of semiconductor materials include silicon, polysilicon, and amorphous silicon. Composite compounds or multilayer structures of two or more of these dielectric materials and semiconductor materials may also be used.

It is desired to optimize the thickness of the diaphragms 20 in view of ejection characteristics. The diaphragms 20 are preferably 0.5 μm to 5 μm in thickness. If the diaphragms 20 are hard, for example, more than 5 μm, a large electric driving force is necessary. On the other hand, if the diaphragms 20 are soft, for example, less than 0.5 μm, the compliance of the individual liquid chambers 17 increases so that the effect of a decrease in ejection efficiency and the effect of resonance are likely to increase.

The actuators 19 are formed on the diaphragms 20. Each of the actuators 19 is formed of the upper electrode 22, the piezoelectric element 21, and the lower electrode 23 stacked in layers. Examples of electrode materials include metals and electrically conductive materials. It is preferable to use electrically conductive oxide materials for materials that come in contact with the piezoelectric elements 21.

It is desired to select an optimum electrode material in accordance with the physical properties, structure, and constituent elements of the piezoelectric elements 21. More specific examples of electrode materials include platinum group oxides such as iridium oxide and palladium oxide and their composite oxides; and oxides and composite oxides of metals such as Ni, Zn, Sn, Ti, Ta, Nb, Mn, Sb, and Bi.

These oxide electrode materials have the problem of extremely high resistivity compared with metals or alloys. Further, these oxide electrode materials have a problem in the stability of electrical contact (connection) with metal interconnect materials, and their contact resistance tends to be high. Therefore, in the case of leading out interconnects from electrodes of these oxides, it is desired to form multiple contacts in order to ensure connection reliability.

In particular, in order to increase the density of the individual liquid chambers 17 and to reduce the size of the inkjet head 100, the diaphragms 20 and the upper and lower electrodes 22 and 23 are reduced in width. This makes it difficult to ensure multiple contacts in a limited area. Further, forming thick films such as the individual electrode interconnects 24 on the diaphragms 20 would reduce vibration efficiency and is thus not preferable. Further, it may also be possible to ensure the contact area by extending the piezoelectric elements 21 to the outside of the diaphragms 20. In this case, however, the piezoelectric elements 21 would be formed in areas where the stresses of the edges of the diaphragms 20 concentrate, so that there is concern about the effect of electric breakdown due to cracks.

In view of these issues, according to this embodiment, contact holes 41 for the individual electrode interconnects 24 are formed in an interlayer insulating film 31 (described below) one on each longitudinal end side of the individual liquid chambers 17, that is, on each of the ink supply opening 15 side and the nozzle 18 side. According to this embodiment, each of the individual electrode interconnects 24 is connected to the corresponding upper electrode 22 via the corresponding two contact holes 41.

Further, according to this embodiment, the individual electrode interconnects 24 are formed on the liquid chamber partition walls 26 separating the individual liquid chambers 17 to be connected to the upper electrodes 22, thereby avoiding wiring on the diaphragms 20 and preventing a decrease in vibration efficiency. According to this embodiment, the above-described configuration makes it possible to ensure the reliability of the electrical connections of the upper electrodes 22 and the individual electrode interconnects 24.

Further, according this embodiment, the interlayer insulating film 31 is formed between interconnection layers where the individual electrode interconnects 24 and the common electrode interconnect 25 are respectively formed and the upper and lower electrodes 22 and 23. The interlayer insulating film 31 serves to protect the piezoelectric elements 21 and to insulate the piezoelectric elements 21 and the interconnection layer from each other. Preferable examples of the material of the interlayer insulating film 31, for which any dielectric may be used, include oxides such as $SiO_2$ and $Al_2O_3$, nitrides such as SiN, TiN, and AlN, and their composite compounds.

The interconnection layers in which the individual electrode interconnects 24 are respectively formed and the piezoelectric elements 21 are electrically connected at the contact holes 41 formed in the interlayer insulating film 31. The interconnection layer in which the common electrode interconnect 25 is formed and the piezoelectric elements 21 are electrically connected at a contact hole 42 formed in the interlayer insulating film 31. A protection layer 43 for interconnect protection is formed on the interconnection layers. The same dielectric material as that of the interlayer insulating film 31 may be used as the material of the protection layer 43. It is desired that the interconnection layers of the individual electrode interconnects 24, the interconnection layer of the common electrode interconnect 25, the interlayer insulating film 31, and the protection layer 43 be 0.5 μm to 5 μm in film thickness in view of interconnect resistance, withstand voltage characteristics, and protection against moisture penetration. Their thicknesses are more preferably 0.5 μm to 2 μm. Further, as illustrated in FIG. 1B, the interlayer insulating film 31 and the protection layer 43 are preferably absent in regions above the diaphragms 20 in order to increase vibration efficiency.

Further, in the inkjet head 100 of this embodiment, the holding substrate 12 in which the common liquid chamber 27 is formed is provided on the channel substrate 10.

The common liquid chamber 27 connected to the ink supply openings 15 and the vibration chambers 14 are formed in the holding substrate 12. The vibration chambers 14 ensure regions (spaces) that allow the movements of the diaphragms 20. The vibration chambers 14 are separated from the common liquid chamber 27 by the joining surface of the common liquid chamber 27 and the channel substrate 10, and serve to ensure vibration regions and to protect the piezoelectric elements 21. Further, according to this embodiment, the partition walls 13 of the vibration chambers 14 are formed in portions of the holding substrate 12 which portions correspond to the liquid chamber partition walls 26 of the individual liquid chambers 17 as illustrated in FIG. 1D (illustrating a cross-sectional shape of the inkjet head 100 taken along the shorter side of the individual liquid chambers 17), thereby reinforcing the mechanical strength of the channel substrate 10.

As described above, the channel substrate 10 has a structure composed of the diaphragms 20 and the liquid chamber partition walls 26 separating the individual liquid chambers 17. Therefore, the channel substrate 10 is a member reduced in strength. Further, the actuators 19, which are multilayer structures, are formed on the diaphragms 20 of the channel substrate 10, so that the channel substrate 10 tends to be subject to warpage because of residual stresses. According to this embodiment, it is possible to ensure the strength of the channel substrate 10 and to reduce the warpage of the channel substrate 10 by joining the holding substrate 12 and the channel substrate 10.

With respect to the material of the holding substrate 12, it is desired to use (select) a suitable material in view of strength and processability. In particular, it is desired to form the partition walls 13 in portions (of the holding substrate 12) corresponding to the liquid chamber partition walls 26 so that the vibration chambers 14 are arranged at the same density as the individual liquid chambers 17. Therefore, it is preferable to use a silicon wafer, which is processable with a semiconductor process, for the material of the holding substrate 12. With respect to the method of processing the vibration chambers 14, it is preferable to use the above-described semiconductor process (photolithography) in order to ensure processing accuracy. Etching techniques such as dry etching and wet etching may be employed. Employment of anisotropic wet etching makes it possible to perform processing with high accuracy.

According to this embodiment, the holding substrate 12 desirably has a thickness that makes it possible to reinforce and protect the channel substrate 10. The thickness differs depending on the material. In the case of using Si, the thickness is preferably 0.3 mm or more. The holding substrate 12 may have a multilayer structure of multiple members in order to ensure a desired strength and the volume of the common liquid chamber 27. In the case of adopting a multilayer structure, microfabrication is necessary only for members adjacent to the channel substrate 10, and metals, resin, etc., may be used for the members of the multilayer structure.

It is desired to seal the channel of the common liquid chamber 27 formed in the holding substrate 12 by joining the holding substrate 12 and the channel substrate 10. Any suitable technique may be used to join the holding substrate 12 and the channel substrate 10. For example, the holding substrate 12 and the channel substrate 10 may be joined with an adhesive agent. In this case, the holding substrate 12 and the channel substrate 10 are joined with a holding substrate adhesion layer 44. It is desired that the joining surface is uniform in level (height). According to this embodiment, if the joining surface varies in level, this variation in level is compensated for by the holding substrate adhesion layer 44. For this purpose, the holding substrate adhesion layer 44 is formed by applying a fluid material thickly and applying pressure to the applied fluid material, thereby achieving uniform joining. However, the material flows at the time of applying pressure. Therefore, there occurs a problem in that the holding substrate adhesion layer 44 on the partition walls 13 of the vibration chambers 14 flows onto the diaphragm 20 to hinder vibrations.

Therefore, according to this embodiment, sealing areas around the partition walls 13 and the common liquid chamber 27, sealed at the time of joining the holding substrate 12 and the channel substrate 10, are caused to serve as the joining surface using the thicknesses of the interlayer insulating film 31, the interconnection layers in which the individual electrode interconnects 24 and the common electrode interconnect 25 are respectively formed, the protection layer 43, the holding substrate adhesion layer 44, and a supply opening periphery interconnection layer 45 (described below).

That is, according to this embodiment, the supply opening periphery interconnection layer 45 is formed (in a joining part) where the channel substrate 10 and the holding substrate 12 are joined around the common liquid chamber 27. Further, according to this embodiment, the individual electrode interconnects 24 are provided in joining regions where the partition walls 13 and the liquid chamber partition walls 26 are joined, and the common electrode interconnect 25 is formed in an edge part of the inkjet head 100. According to this embodiment, this configuration makes it possible to perform ink sealing and to ensure the strength of the channel substrate 10 at the same time.

Figure 2A:
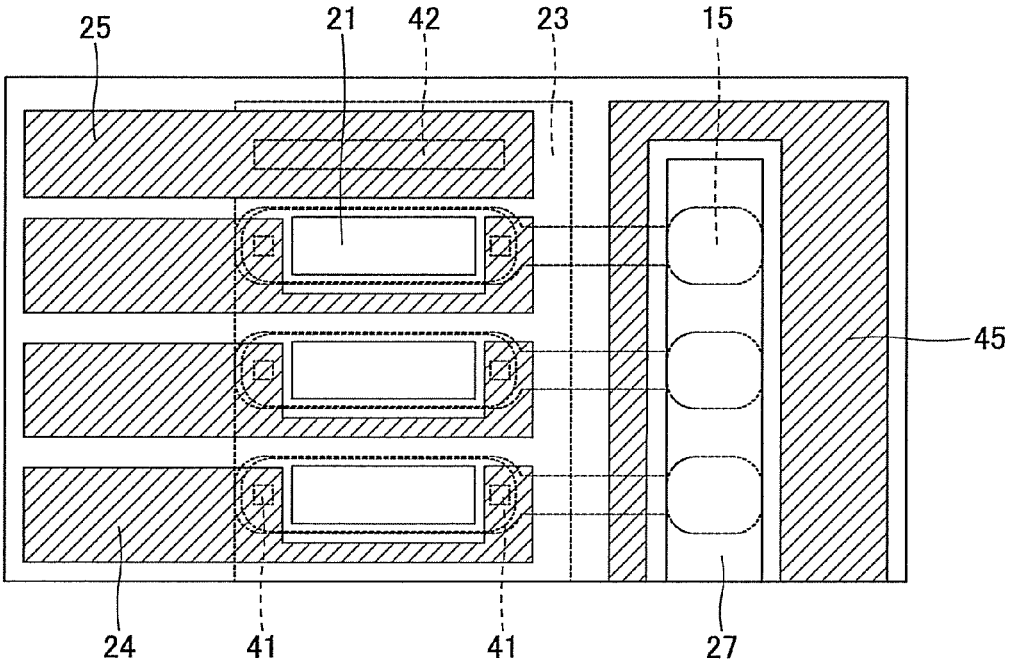
FIGS. 2A and 2B are diagrams illustrating patterns of interconnection layers according to the first embodiment.
Figure 2B:
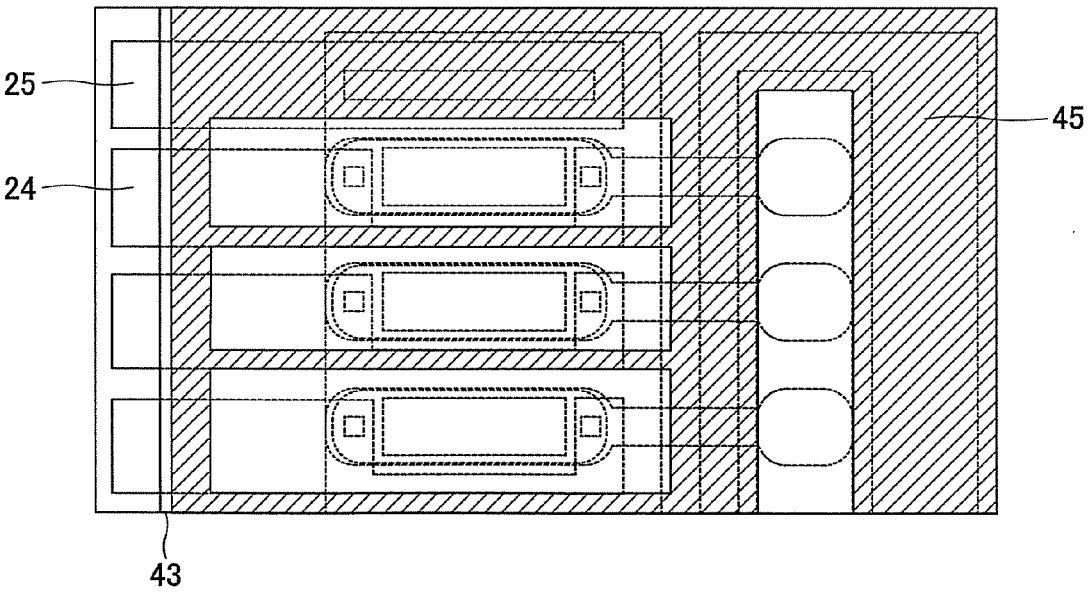

Next, a description is given, with reference to FIGS. 2A and 2B, of patterns of the interconnection layers of the inkjet head 100. FIGS. 2A and 2B are diagrams illustrating patterns of the interconnection layers. FIG. 2A illustrates patterns of led-out interconnection layers, and FIG. 2B illustrates a joining area of the holding substrate 12.

According to this embodiment, it is possible to improve the performance of the sealing of the channel substrate 10 and the holding substrate 12 and the reliability of the joining of the channel substrate 10 and the holding substrate 12 using the patterns of the interconnection layers. At this point, the common liquid chamber 27 is surrounded in order to electrically isolate the supply opening periphery interconnection layer 45 from the individual electrode interconnects 24. As illustrated in FIGS. 1C and 1D, the layer configuration around the partition walls 13 is substantially the same as the layer configuration around the common liquid chamber 27. Although the lower electrode 23 is formed under the interlayer insulating film 31 in the multilayer structures around (corresponding to) the partition walls 13, the lower electrode 23 is thin enough to not affect the joining of the channel substrate 10 and the holding substrate 12, compared with the interlayer insulating film 31, the individual electrode interconnects 24, and the protection layer 43. That is, the thickness of the lower electrode 23 may be absorbed by the elastic deformation of the holding substrate adhesion layer 44, and does not affect the reliability of the joining.

Figure 3:
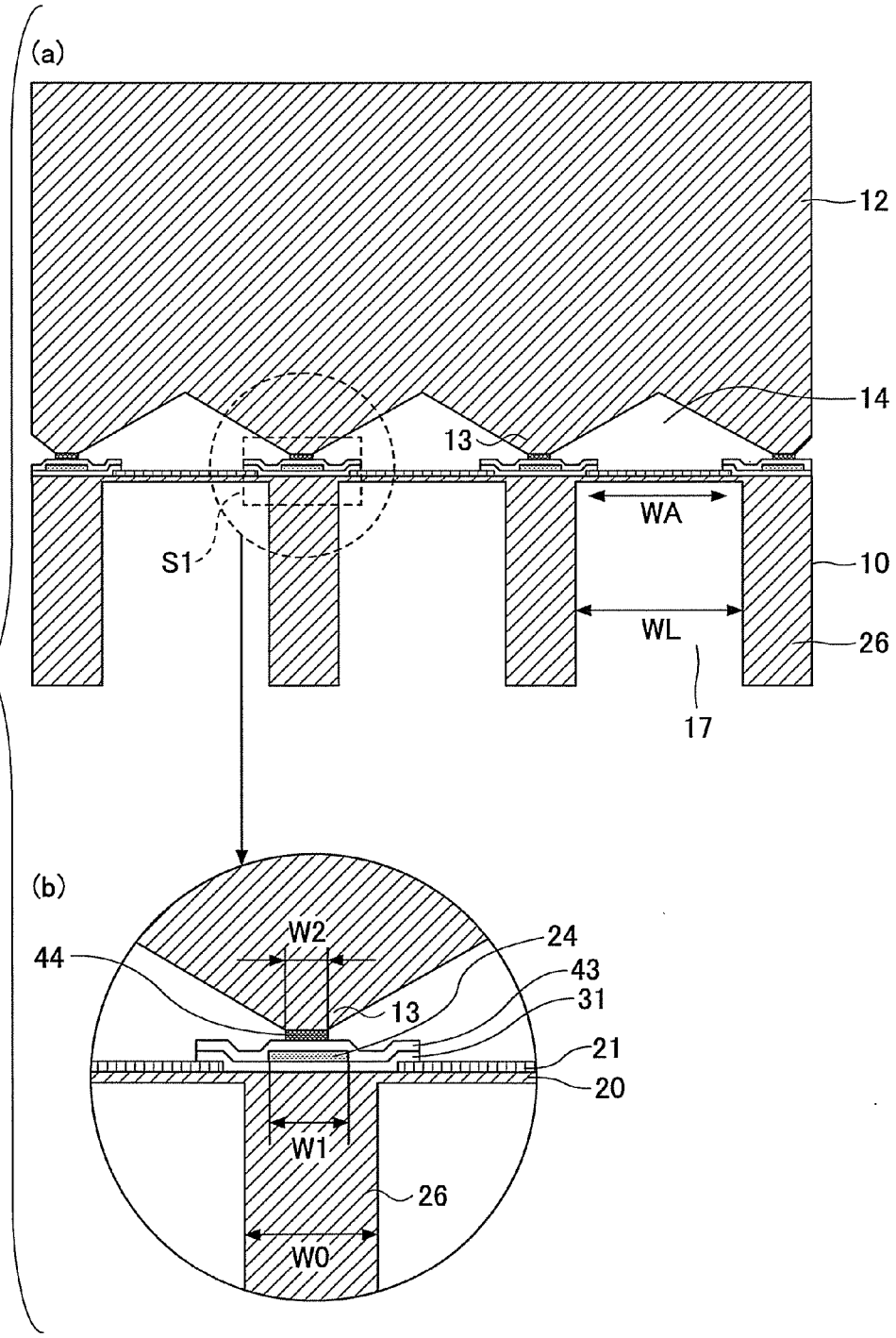
FIG. 3 is a diagram for illustrating the widths of a partition wall, a liquid chamber partition wall, and an individual electrode interconnect according to the first embodiment.

Next, a description is given, with reference to FIG. 3, of the widths of the partition walls 13, the liquid chamber partition walls 26, and the individual electrode interconnects 24 according to this embodiment. FIG. 3 is a diagram for illustrating the widths of the partition walls 13, the liquid chamber partition walls 26, and the individual electrode interconnects 24. In FIG. 3, (a) illustrates the joining of the channel substrate 10 and the holding substrate 12, and (b) is an enlarged view of a joining part circled by a broken line in (a). Here, (a) of FIG. 3 is a cross-sectional view corresponding to FIG. 1D, but is closer to an actual shape.

Referring to (b) of FIG. 3, according to this embodiment, letting the width of the partition wall 13, the width of the liquid chamber partition wall 26, and the width of the individual electrode interconnect 24 formed in a partition wall region S1 (a region around the partition wall 13) be W2, W0, and W1, respectively, it is preferable that W2, W0, and W1 satisfy W2<W1<W0. The relationship between Width W1 and Width W0 is determined by the positioning accuracy of a photomask for forming the individual liquid chambers 17 and the positioning accuracy of a photomask for the individual electrode interconnects 24.

That is, it is desired that Width W1, which corresponds to a positioning margin, be smaller than Width W0. If W1>W0, or if the individual electrode interconnect 24 protrudes outside the partition wall region S1 because of the mispositioning of the individual electrode interconnect 24, a thick interconnection layer is formed on the diaphragm 20 to cause the degradation of vibration characteristics and a decrease in ejection performance.

Likewise, it is desired that Width W2 of the partition wall 13 formed in the holding substrate 12 be smaller than Width W1 in consideration of the accuracy of positioning at the time of joining. That is, if W1<W2, the joining area has an overlap on the diaphragm 20 side because of joining misalignment. Further, in the case of using an adhesive (adhesion) layer having fluidity or subject to plastic deformation, the holding substrate adhesion layer 44 protrudes onto the diaphragm 20 because of applied pressure at the time of joining, thereby reducing vibrations to degrade ejection performance and ejection uniformity.

According to this embodiment, by causing W1 to be greater than W2 (W1>W2), it is possible to reduce an adverse effect on the diaphragm 20 due to the joining misalignment of the holding substrate 12 or the protrusion of the holding substrate adhesion layer 44, and to ensure ejection performance and ejection uniformity.

As described above, the holding substrate 12 serves to reinforce the channel substrate 10. By having the holding substrate 12 serve the same function in the manufacturing process of the inkjet head 100 as well, it is possible to stabilize the manufacturing process. FIGS. 4A through 4E illustrate a method of manufacturing an inkjet head according to the first embodiment.

Figure 4A:
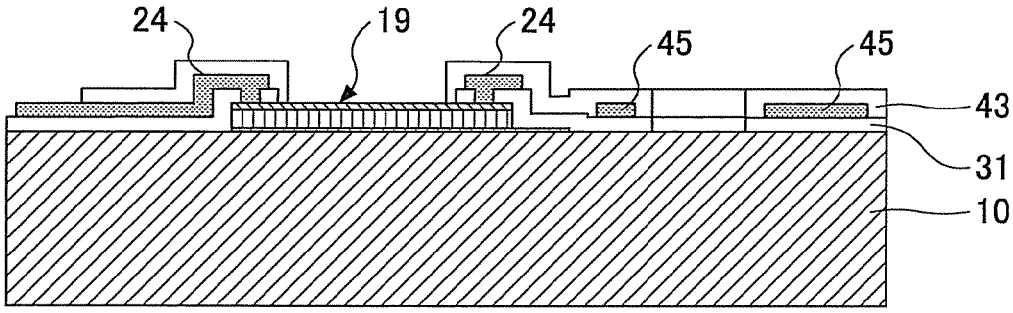
FIGS. 4A through 4E are diagrams illustrating a method of manufacturing an inkjet head according to the first embodiment.

Referring to FIG. 4A, the actuators 19 are formed (by successively stacking the lower electrode 23, the piezoelectric elements 21, and the upper electrodes 22 and performing patterning) on the channel substrate 10 before formation of the supply openings 15, the individual liquid chambers 17, and the fluid resistance parts 16. Then, the interlayer insulating film 31 is formed, and the contact holes 41 and 42 are formed in the interlayer insulating film 31. Thereafter, the interconnection layers are formed, and the individual electrode interconnects 24, the common electrode interconnect 25, and the supply opening periphery interconnection layer 45 are patterned. Simultaneous formation and patterning of these interconnection layers makes it possible for these interconnection layers to be uniform (equal) in thickness, so that it is possible to cause the joining surface of the channel substrate 10 and the holding substrate 12 to be uniform in level (height). Next, the protection layer 43 is formed, and portions above the piezoelectric elements 21 and portions to become the ink supply openings 15 are removed from the protection layer 43.

Figure 4B:
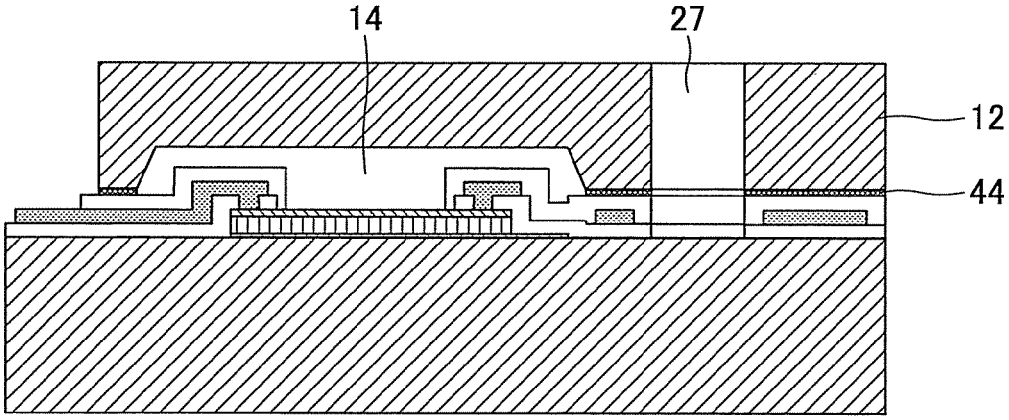

Referring to FIG. 4B, the channel substrate 10 and the holding substrate 12 are joined. The vibration chambers 14 and the common liquid chamber 27 are formed in the holding substrate 12. The holding substrate adhesion layer 44 is applied on the joining part (joining area) of the holding substrate 12, and the holding substrate 12 and the channel substrate 10 are pressed and joined. Any material may be used as the material of the holding substrate adhesion layer 44 in accordance with a substrate material. Common epoxy resin, acrylate resin, etc., may be used.

Figure 4C:
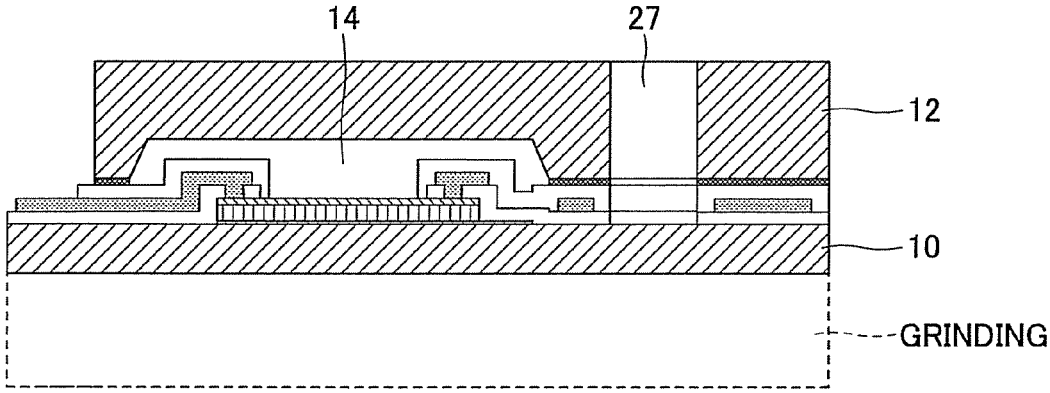

Referring to FIG. 4C, after being joined to the holding substrate 12, the channel substrate 10 is mechanically ground to have a thickness corresponding to the depth of the individual liquid chambers 17. According to the inkjet head 100 of this embodiment, the individual liquid chambers 17 are preferably 50 μm to 100 μm in thickness.

In the grinding process, the holding substrate 12 ensures substrate strength in the process of reducing the thickness of the channel substrate by grinding. At the same time, the holding substrate 12 is evenly joined to the channel substrate 10 through the above-described interconnection patterns around the partition walls 13 (FIG. 1D) of the vibration chambers 14 and the common liquid chamber 27. Accordingly, the grinding thickness of the liquid chamber formation parts of the channel substrate 10, that is, the depth of the individual liquid chambers 17, can be made uniform.

Figure 4D:
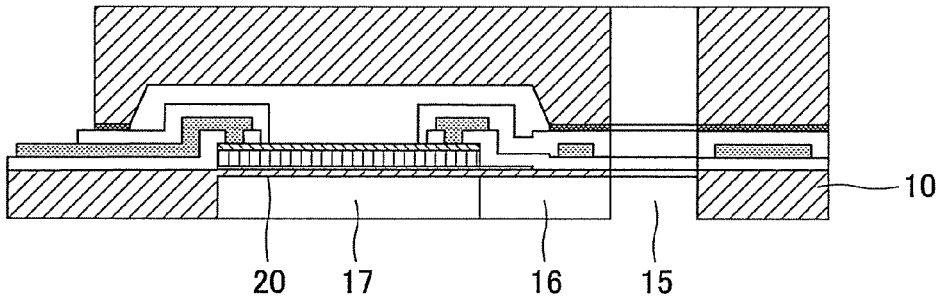

Referring to FIG. 4D, according to this embodiment, channels such as the individual liquid chambers 17, the fluid resistance parts 16, and the ink supply openings 15 are formed after the grinding, so that the channel substrate 10 is completed. The channel substrate 10 is so processed by etching as to leave the diaphragms 20. The diaphragms 20 may be formed to have an oxide or nitride etching stopper layer at their surfaces on the individual liquid chamber 17 side. By using such an etching stopper layer, it is possible to leave the diaphragms 20 and to form the individual liquid chambers 17 with uniform depth with high accuracy.

Figure 4E:
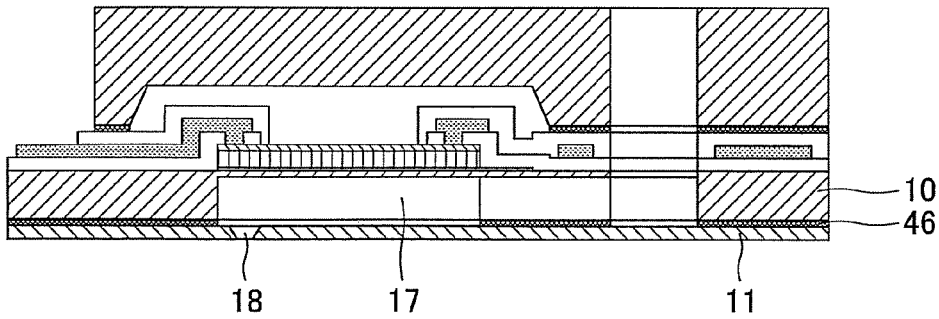

Referring to FIG. 4E, the nozzle plate 11 in which the nozzles 18 (nozzle openings) are formed is joined to the formed channels. The nozzle plate 11 and the channel substrate 10 are pressed and joined with the nozzle plate adhesion layer 46 using an adhesive agent. It is desired that the liquid chamber partition walls 26 (FIG. 1D) of the individual liquid chambers 17 be evenly joined. Poor joining of the liquid chamber partition walls 26 results in a leakage path between adjacent individual liquid chambers 17, thus causing crosstalk in the case of driving the adjacent individual liquid chambers 17.

According to this embodiment, the partition walls 13 separating the vibration chambers 14 of the holding substrate 12 and the liquid chamber partition walls 26 of the channel substrate 10 are joined (through the multilayer structures as described above, that is, with the multilayer structures interposed between the holding substrate 12 and the channel substrate 10). Accordingly, even in the case of applying pressure to the channel substrate 10 and the nozzle plate 11 through the holding substrate 12, the relatively thin channel substrate 10 is prevented from deforming. Therefore, it is possible to evenly apply pressure to the liquid chamber partition walls 26. As a result, according to this embodiment, the reliability of the joining of the liquid chamber partition walls 26 and the nozzle plate 11 is improved, so that the inkjet head 100 is free of leaks between the individual liquid chambers 17 and reduced in crosstalk.

Second Embodiment

A description is given, with reference to the drawings, of a second embodiment of the present invention. In the following description of the second embodiment of the present invention, the elements having the same functional configurations as those of the first embodiment are referred to by the same reference numerals, and a description thereof is omitted.

Figure 5:
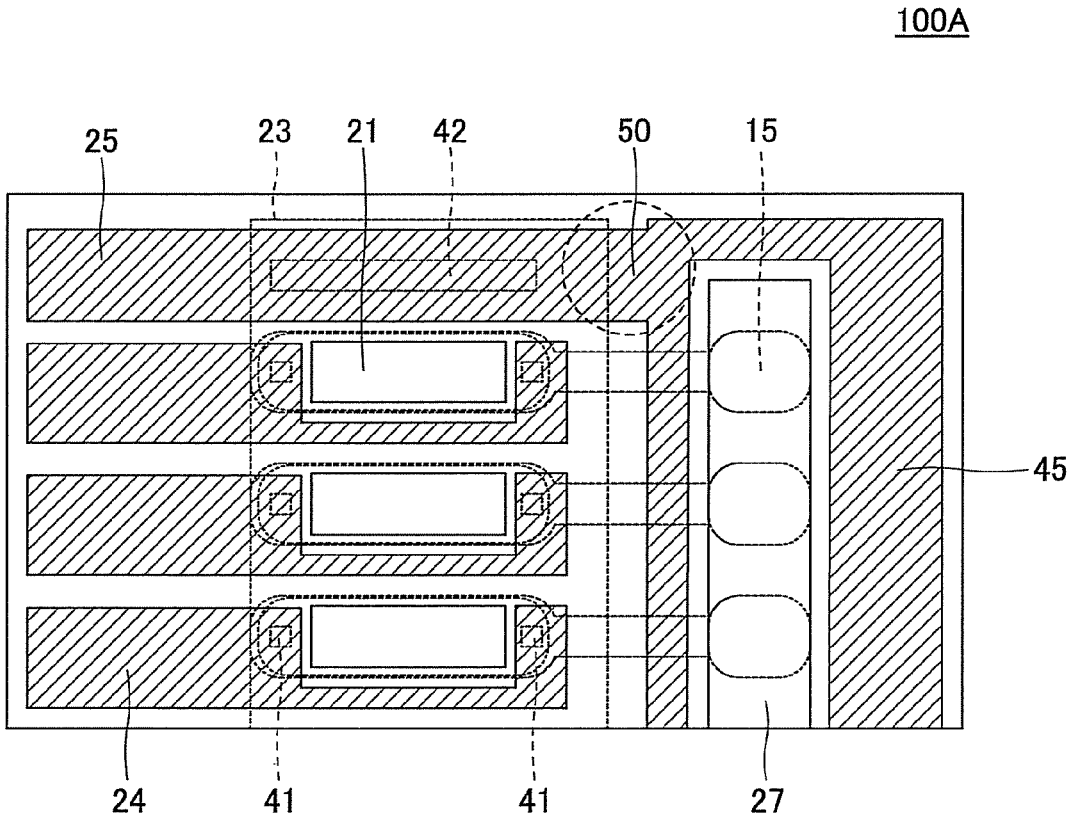
FIG. 5 is a diagram illustrating an inkjet head according to a second embodiment of the present invention.

FIG. 5 is a diagram illustrating an inkjet head 100A according to the second embodiment of the present invention. The inkjet head 100A of the second embodiment has the same configuration as the inkjet head 100 of the first embodiment except for the shapes of the interconnection layers.

Referring to FIG. 5, the inkjet head 100A has a connection part 50 that electrically connects the common electrode interconnect 25 and the supply opening peripheral interconnection layer 45. According to this embodiment, the presence of the connection part 50 causes the supply opening peripheral interconnection layer 45 and the lower electrode 23 to be equal in potential. However, the ink contact part is protected by the protection layer 43 and is therefore subject to no electrical effect. Further, since it is possible to use the sealing area of the ink supply openings 15 as the bypass interconnect of the upper electrodes 22, it is possible to reduce the voltage drop of the common electrode interconnect 25, so that it is possible to improve the uniformity of ink liquid droplet ejection of each of the nozzles 18.

According to an aspect of the present invention, it is possible to improve the connection reliability of the upper electrodes (individual electrodes) of piezoelectric elements and the rigidity of the edges of diaphragms.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. An inkjet head, comprising:

a channel substrate having a plurality of individual liquid chambers arranged in a shorter-side direction thereof, the individual liquid chambers being separated by a plurality of liquid chamber partition walls and communicating with ink supply openings;

a plurality of diaphragms defining surfaces of the individual liquid climbers facing toward nozzle openings;

a plurality of actuators formed on the diaphragms, wherein each of the actuators includes a lower electrode, a piezoelectric element, and an upper electrode that are stacked in layers;

a plurality of individual electrode interconnects led out from the upper electrodes of the actuators, the individual electrode interconnects being connected to the corresponding upper electrodes on a nozzle opening side and on an ink supply opening side of the upper electrodes, the individual electrode interconnects being formed in regions where the liquid chamber partition walls are formed; and a holding substrate having a plurality of vibration chambers and a plurality of partition walls separating the vibration chambers, the vibration chambers being recesses corresponding to the diaphragms, the vibration chambers and the partition walls being arranged in a shorter-side direction of the holding substrate, wherein the partition walls of the holding substrate and the liquid chamber partition walls of the channel substrate are joined with the individual electrode interconnects interposed therebetween.

2. The inkjet head as claimed in claim 1, further comprising:

an interconnection pattern having a film thickness equal to a film thickness of the individual electrode interconnects and formed in an area surrounding the ink supply openings, wherein the holding substrate and the channel substrate are joined with an adhesive layer, and the holding substrate includes a common liquid chamber communicating with the ink supply openings of the channel substrate.

3. The inkjet head as claimed in claim 1, wherein the individual electrode interconnects are smaller in width than the liquid chamber partition walls in the shorter-side direction of the channel substrate.

4. The inkjet head as claimed in claim 1, wherein the partition walls are smaller in width than the individual electrode interconnects in the shorter-side direction of the holding substrate.

5. The inkjet head as claimed in claim 1, further comprising:

an interlayer insulating film formed under the individual electrode interconnects; and a protection layer formed of an insulator on the individual electrode interconnects, wherein the individual electrode interconnects are connected to the corresponding upper electrodes via a plurality of contact holes, and the channel substrate and the holding substrate are joined with at least the interlayer insulating film, the individual electrode interconnects, and the protection layer interposed therebetween.

6. The inkjet head as claimed in claim 2, wherein the interconnection pattern formed in the area surrounding the ink supply openings is electrically connected to a common electrode interconnect led out from the lower electrode.

* * * * *